US006135607A

United States Patent [19]

Cook

[11] Patent Number: 6,135,607

[45] Date of Patent: Oct. 24, 2000

[54] LIGHTWEIGHT ANGULAR TOOL EXTENDING APPARATUS AND LIGHT

[76] Inventor: Jesse James Cook, 1950 S. Ocean Blvd., #312, Pompano Beach, Fla. 33062

[21] Appl. No.: 09/206,754

[22] Filed: Dec. 7, 1998

Related U.S. Application Data

[63] Continuation-in-part of application No. 08/988,954, Dec. 11, 1997.

[51] Int. Cl.[7] ..... B25B 23/18

[52] U.S. Cl. ..... 362/119; 362/120; 362/109; 362/253; 81/52; 81/3.09; 81/3.15; 81/3.36; 81/450

[58] Field of Search ..... 362/119, 109, 362/120, 253; 81/177.4, 53, 45, 58.1, 111, 92, 484, 3.56, 3.57, 3.32, 3.36, 3.29, 3.25, 3.15, 52, 901, 440, 442, 448, 450

[56] References Cited

U.S. PATENT DOCUMENTS 1,398,234 11/1921 Landis ..... 81/450

5,899,554 7/1998 Hsu ..... 362/119

5,913,596 6/1999 Lin ..... 362/120

*Primary Examiner*—Sandra O'Shea

*Assistant Examiner*—Bertrand Zeade

*Attorney, Agent, or Firm*—Scott L. Lampert

[57] ABSTRACT

A lightweight tool extending apparatus comprising an outer member having a lower end structured for interconnection with a drive ratchet, an inner member structured for insertion into the outer member in sliding relation thereto and having an upper end structured for interconnection with a drive head, a universal joint structured to rotate and pivot about its longitudinal axis so that the outer member may be angled relative to the inner member, a light mounted to the inner member structured to generate a focused light beam above the upper end of the inner member, and a depressible button in a side of the inner member structured to protrude through one of a plurality of holes in a corresponding side of the outer member, thereby securing the inner and outer members in place relative to one another.

17 Claims, 3 Drawing Sheets

LIGHTWEIGHT ANGULAR TOOL EXTENDING APPARATUS AND LIGHT

This is a continuation-in-part of application Ser. No. 08/988,954, filed Dec. 11, 1997, which has not previously been patented or abandoned.

BACKGROUND OF THE INVENTION

1. Field of the Invention

The present invention relates to tools and, more particularly, to a lightweight tool extending apparatus which may be angled to facilitate use of tools in locations which are not easily accessible and which includes a focused light to illuminate the desired work area.

2. Description of the Related Art

The need to work with tools in locations which are difficult to reach is not uncommon. Repairmen, builders, plumbers, auto mechanics, homeowners and others frequently encounter applications which require them to work in locations, such as under sinks, bathroom and kitchen basins and automobiles, behind appliances, inside walls, etc., which are not easily accessible. Thus, extensions for tools are necessary to provide the ability to reach and work in such inaccessible locations.

Ratchet and socket tools are the most commonly used tools for applications which are difficult to reach. Extensions for standard ratchet and socket tools have been developed to address this problem and are readily available. For instance, U.S. Pat. No. 5,138,911 discloses a telescopic extension device comprising a tubular member, a shaft member structured to slidingly extend into the tubular member and releasable engaging means structured to maintain the shaft member at predetermined positions within the tubular member.

Although the prior art devices are useful for their intended purposes, they have certain inherent limitations and, consequently, have not proven to be entirely effective. Specifically, these devices are structured to be extended along a single longitudinal axis. Thus, users are forced to position the device directly in line with the nut, bolt, etc. to be loosened or tightened. This is often difficult to accomplish when the nut, bolt, etc. is in a location which is obstructed by other items, such as under sinks, in automobile engines, behind appliances, etc. In such situations, the user is often forced into an awkward, and usually uncomfortable, position to try to position the extension device and tool so that the nut, bolt, etc. may be accessed.

Moreover, when working in such difficult to access positions, such as under sinks and automobiles, it is usually dark and difficult to see. Thus, users are forced to provide some sort of lighting to enable them to see what they are doing. This is often accomplished by balancing a flashlight under the sink or automobile so that the light is focused on the desired location. However, such process is cumbersome and many times results in the flashlight falling over. Also, it requires the user to carry a flashlight, in addition to all of the other tools, to the work location.

Accordingly, there is still a need in the art for a tool extending apparatus which includes a plurality of members which may be angled relative to one another so that it may be extended around obstructions, thereby reducing the need for users to crawl underneath sinks, automobiles and other tight locations. Any such device should include a focused light to easily illuminate the desired work area and should be lightweight, compact, adjustable to accommodate applications of varying lengths and simple to operate. The present invention is particularly suited to overcome those problems which remain in the art in a manner not previously known.

SUMMARY OF THE INVENTION

The present invention is directed towards a new and improved tool extending apparatus comprising an inner tube-like member having a lower member with a depressible button disposed in a side thereof and an upper member having an open upper end structured for interconnection with a standard drive head, an outer tube-like member structured for interconnection with a standard drive ratchet and sized to contain the inner member therein in sliding relation thereto, a universal joint and a light structured and disposed to direct a light beam above the upper end of the upper member. The lower and upper members are secured to opposite ends of the universal joint so that they may be rotated and pivoted in relation to one another. The outer member further includes a plurality of holes, each structured to accept the depressible button therethrough, disposed longitudinally along a side thereof so that the position of the inner and outer members relative to one another may be varied and, correspondingly, the apparatus extended or contracted. The light is removably secured to the inner member, in parallel relation thereto, by a retaining clip attached to the inner member adjacent the upper end. An adapter, structured for removable insertion into the open lower end of the outer member, enables use with drive ratchets of varying sizes. A tube-shaped handle may be inserted through opposite holes in the open lower end of the outer member to facilitate gripping and manipulation of the apparatus.

It is an object of the present invention to provide a new and improved tool extending apparatus which has all the advantages of the prior art cover devices and none of the disadvantages.

It is another object of the present invention to provide a tool extending apparatus for use in hard to reach applications.

It is yet another object of the present invention to provide such an apparatus which includes a plurality of members which may be angled relative to one another so that it may be extended around obstructions.

It is a further object of the present invention to provide such an apparatus which includes a light capable of focusing on the desired work location.

It is yet a further object of the present invention to provide such an apparatus which may be used with standard ratchet, socket and/or crows foot tools.

It is also an object of the present invention to provide such an apparatus which is lightweight, compact, adjustable to accommodate applications of varying lengths and simple to maneuver and operate.

These and other objects and advantages of the present invention will become more readily apparent in the description which follows.

BRIEF DESCRIPTION OF THE DRAWINGS

For a further understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
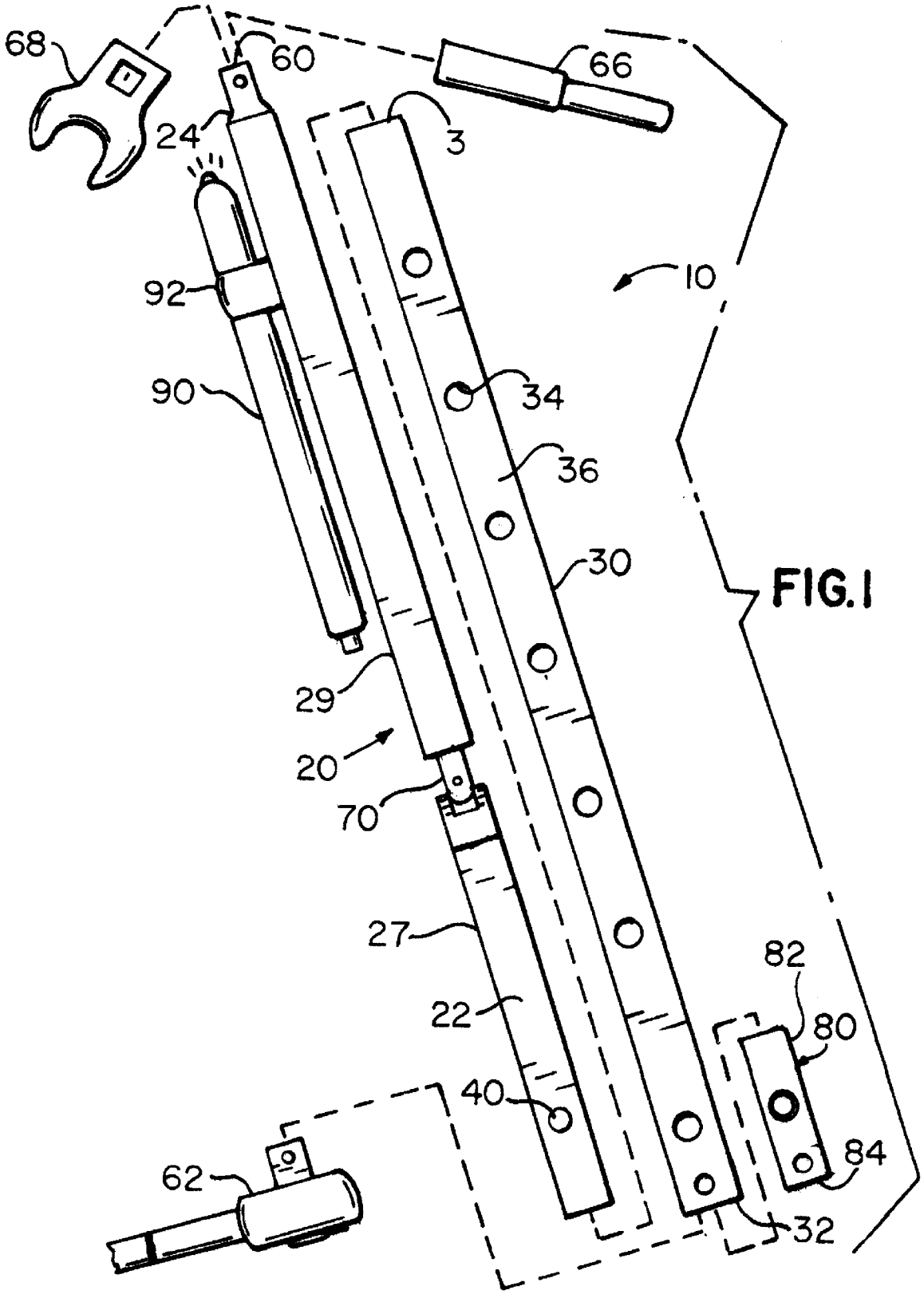
FIG. 1 is an exploded view of the tool extending apparatus of the present invention
Figure 2:
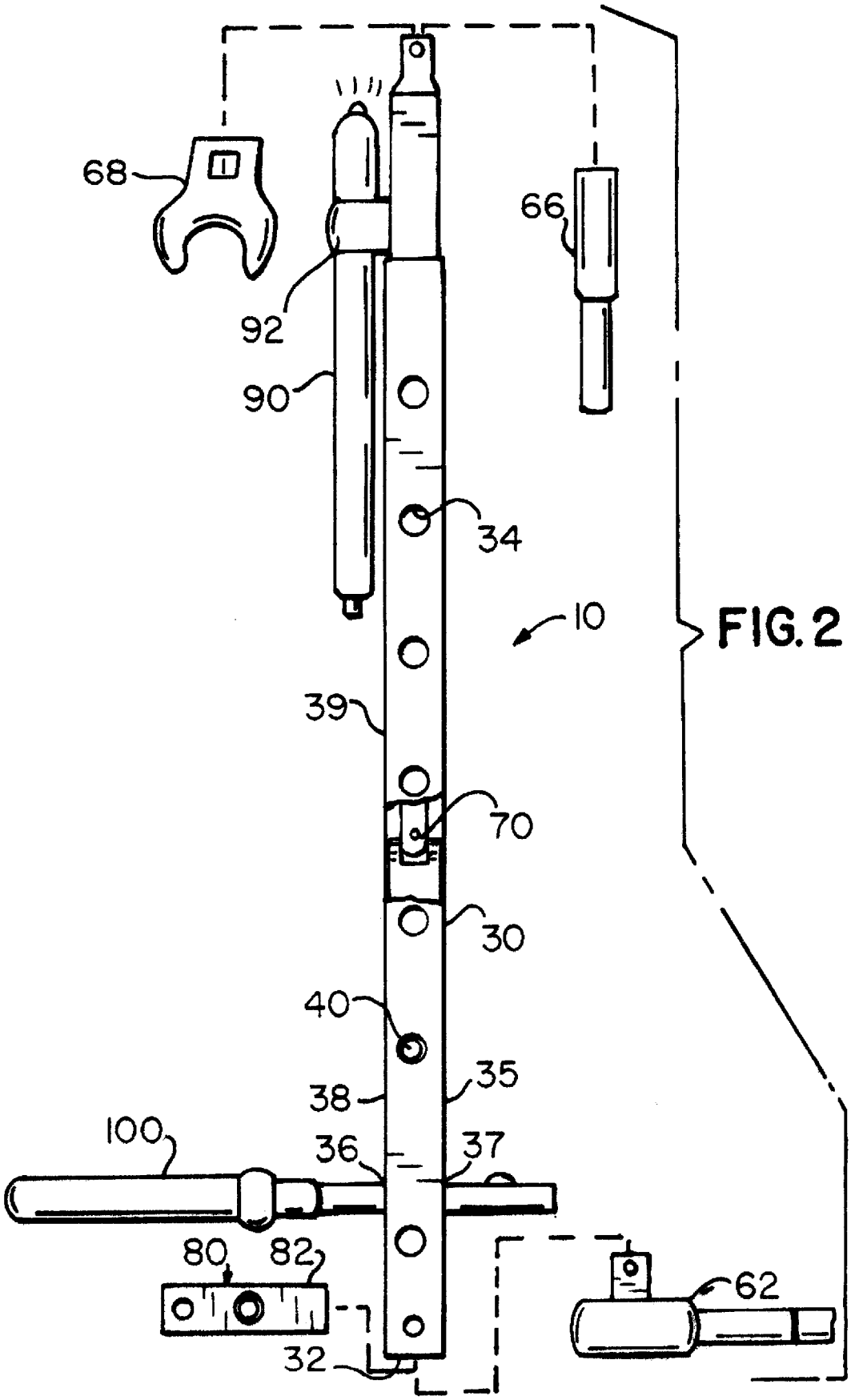
FIG. 2 is a front plan view of the tool extending apparatus of the present invention in partial section showing the universal joint and the various attachments.
Figure 3:
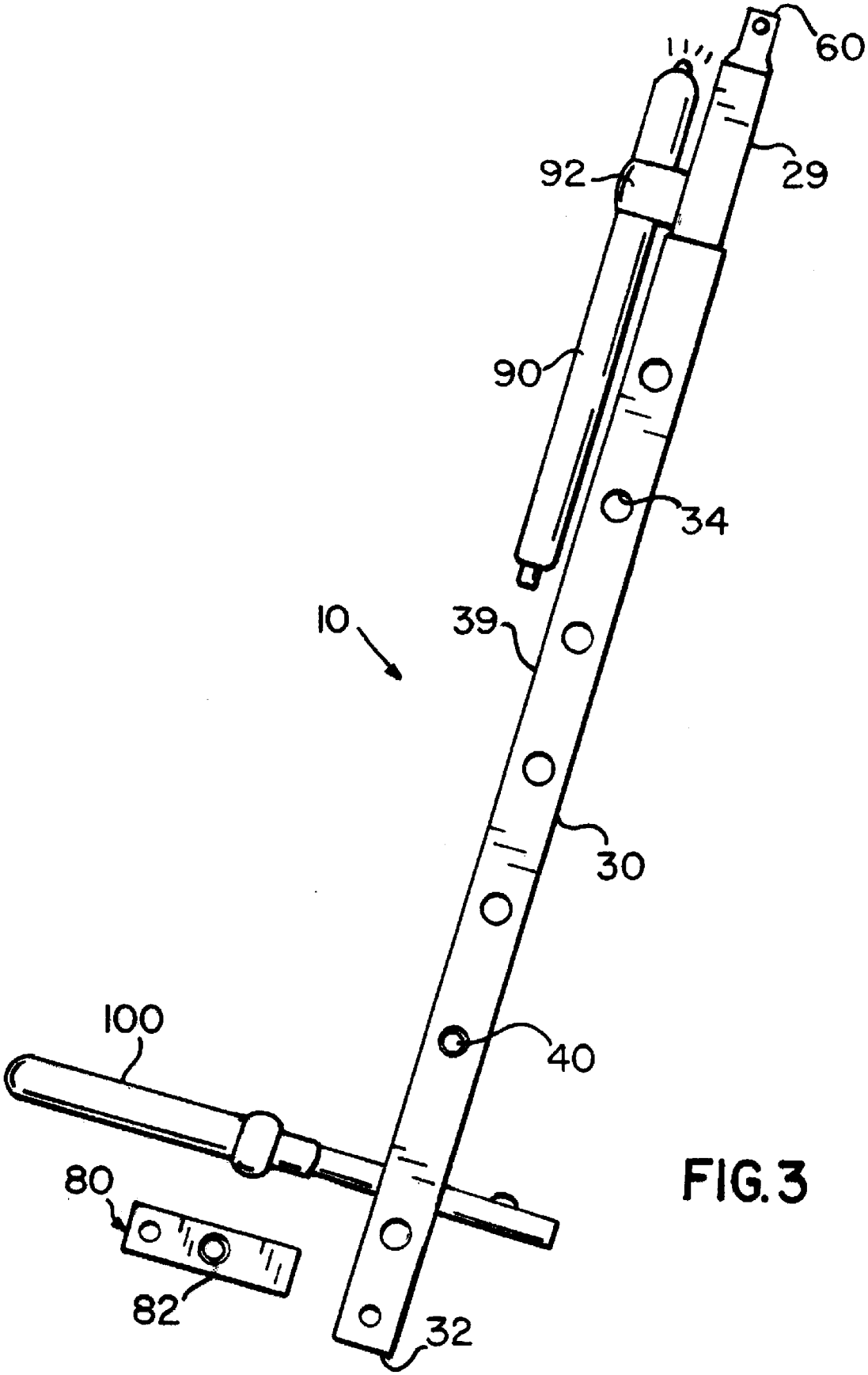
FIG. 3 is a front plan view of the tool extending apparatus of the present invention.

As shown in FIGS. 1–3, the present invention is directed towards a new and improved lightweight tool extending apparatus 10 comprising an inner tube-like member 20, an outer tube-like member 30, a universal joint 70 and a light 90. The outer member 30 is sized to contain the inner member therein 20 in sliding relation thereto and includes an open lower end 32 structured for interconnection with a standard drive ratchet 62 of a socket and ratchet set. The outer member 30 further includes a plurality of holes 34 disposed longitudinally along a side 36 thereof.

Referring now to FIG. 1, the inner member 20 includes a lower member 27 having a depressible button 40 disposed in a side 22 thereof and an upper member 29 having an open upper end 24 structured for interconnection with a standard drive head 60. The lower 27 and upper 29 members are secured to opposite ends of the universal joint 70 so that they may be rotated and pivoted in relation to one another. When the lower member 27 of the inner member 20 is secured within the outer member 30, the inner 20 and outer 30 members may be twisted and angled relative to one another by rotating or pivoting the universal joint 70.

The button 40 is sized and shaped to protrude through one of the plurality of holes 34, thereby securing the inner member 20 and outer 30 members in place relative to one another. The position of the inner member 20 relative to the outer member 30 may be varied and, correspondingly, the apparatus 10 extended or contracted, by depressing the button 40 and sliding the inner member 20 within the outer member 30 until the button 40 protrudes through another one of the holes 34.

In the preferred embodiment, both the inner 20 and outer 30 members are constructed of aluminum to ensure that the apparatus 10 is strong, durable and lightweight. However, they may, alternatively, be constructed of any other suitable material. The cross sectional shape of the inner 20 and outer 30 members may be generally circular, square or any other suitable shape.

The inner member 20 preferably has an inside diameter of ⅜ inches and is interconnected with a standard ⅜ inch drive head 60 by inserting the drive head 60 into the open upper end 24. Similarly, the outer member 30 has an inside diameter of ½ inches and is interconnected with a standard ½ inch drive ratchet 62 by inserting the drive ratchet 62 into the open lower end 32. The inner 20 and outer 30 members may, alternatively, have different size inside diameters to accommodate drive heads 60 and drive ratchets 62 of differing sizes.

The light 90 is removably secured to the inner member 20, in parallel relation thereto, by a retaining clip 92 attached to the inner member 20 adjacent the upper end 24. The light 90 is structured and disposed to direct a light beam above the upper end 24 to enhance the visability of the area upon which the user is working. The light 90 is preferably battery operated and substantially thin and tube-shaped.

Referring now to FIG. 3, the retaining clip 92 raises the light 90 off of the inner member 20 a sufficient distance so that the outer member 30 may slide over the inner member 20 with one sidewall 39 in the gap between the light 90 and the inner member 20. Thus, the inner member 20 may be inserted almost completely within the outer member 30 for storage. Other suitable retaining means known in the art may, alternatively, be used.

A mirror (not shown) may be attached to the apparatus adjacent the universal joint 70 to enable the user to view the upper end 24 and the surrounding work area without having to position himself directly along the longitudinal axis of the upper member 29. Alternatively, a scope or other similar device may be provided.

The apparatus 10 of the present invention further includes an adapter 80 for interconnecting the lower end 32 of the outer member 30 with drive ratchets 62 of varying sizes. The adapter 80 includes a first end 82 with a certain outside diameter structured for removable insertion into the open lower end 32 of the outer member 30 and an opposite open second end 84 with a certain inside diameter structured to accept the drive ratchet 62 therein. In the preferred embodiment, the outside diameter of the first end 82 of the adapter 80 is approximately ½ inches for insertion into the open lower end 32 of the outer member 30. The inside diameter of the hollow, open second end 84 of the adapter 80 may be ⅜ inches for use with a ⅜ inch drive ratchet 62 or any other size for use with a different size drive ratchet 62.

The apparatus 10 of the present invention can be used with any socket and ratchet attachment to accommodate the particular application. For instance, a deepwell socket 66, a crows foot open end wrench 68 or any other socket attachment may be inserted onto the drive head 60.

The apparatus 10 of the present invention further includes a tube-shaped handle 100 structured and disposed for gripping and manipulating the apparatus 10 and securing the adapter 80 in the open lower end 32 of the outer member 30. The handle 100 is sized and shaped for removable insertion through a first hole 36 in a first side 38 of the open lower end 32 of the outer member 30 and a second hole 37 in a second opposite side 35 of the open lower end 32 of the outer member 30. The handle 100 facilitates the turning of the apparatus 10 and the attached deepwell socket 66 or crows foot open end wrench 68, thereby loosening the desired nut, bolt, etc. without a drive ratchet 62.

The first 36 and second 37 holes may be aligned with the hole 82 in the adapter 80 when the adapter 80 is seated within the open lower end 32 of the outer member 30, so that the adapter 80 may be secured within the open lower end 32 by inserting the handle 100 through the first hole 36 of the first side 38 of the outer member 30, the hole 82 in the adapter 80, and the second hole 37 of the second opposite side 35 of the outer member 30. Other suitable attachment means known in the art may, alternatively, be used to secure the adapter 80 within the open lower end 32.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A lightweight tool extending apparatus comprising:

an outer tube-like member having a lower end structured for interconnection with a drive ratchet and an opposite open upper end;

an inner tube-like member structured for insertion into said upper end of said outer member in sliding relation thereto, said inner member having an upper portion with an upper end structured for interconnection with a drive head and a lower portion;

means for translating said upper portion relative to said lower portion and said outer member; and means for removably securing said inner member within said outer member so that the position of said inner member relative to said outer member may be varied between a first extended position, wherein said inner member is substantially removed from said outer member, to a second retracted position, wherein said inner member is substantially within said outer member.

2. A lightweight tool extending apparatus as recited in claim 1 wherein said means for translating said upper portion relative to said lower portion and said outer member comprises a universal joint structured to rotate and pivot about its longitudinal axis.

3. A lightweight tool extending apparatus as recited in claim 1 wherein said means for removably securing said inner member to said outer member comprises a depressible button in a side of said inner member, said button being sized and shaped to protrude through one of a plurality of holes in a corresponding side of said outer member, thereby securing said inner and outer members in place relative to one another, whereby said position of said inner member relative to said outer member may be varied by depressing said button and sliding said inner member within said outer member until said button protrudes through another one of said holes.

4. A lightweight tool extending apparatus as recited in claim 1 further comprising means for generating a focused light beam above said upper end of said inner member.

5. A lightweight tool extending apparatus as recited in claim 4 wherein said means for generating a focused light beam above said upper end of said inner member comprises a generally tube-shaped flashlight mounted to said inner member in generally parallel relation thereto.

6. A lightweight tool extending apparatus as recited in claim 1 further comprising an adapter for interconnecting said lower end of said outer member with said drive ratchets of varying sizes, said adapter having a first end with a certain outside diameter structured for removable interconnection with said lower end of said outer member and an opposite second open end with a certain inside diameter structured for interconnection with said drive ratchet.

7. A lightweight tool extending apparatus as recited in claim 1 further including a generally tube-like handle structured for removable insertion through a pair of opposing holes in said lower end of said outer member, said handle being structured to facilitate gripping and manipulating of said apparatus.

8. A lightweight tool extending apparatus comprising:

an outer tube-like member having a lower end structured for interconnection with a drive ratchet and an opposite open upper end;

an inner tube-like member structured for insertion into said upper end of said outer member in sliding relation thereto, said inner member having an upper portion with an upper end structured for interconnection with a drive head and a lower portion;

means for translating said upper portion relative to said lower portion and said outer member;

means for removably securing said inner member within said outer member so that the position of said inner member relative to said outer member may be varied between a first extended position, wherein said inner member is substantially removed from said outer member, to a second retracted position, wherein said inner member is substantially within said outer member; and means for generating a focused light beam above said upper end of said inner member.

9. A lightweight tool extending apparatus as recited in claim 8 wherein said means for translating said upper portion relative to said lower portion and said outer member comprises a universal joint structured to rotate and pivot about its longitudinal axis.

10. A lightweight tool extending apparatus as recited in claim 8 wherein said means for removably securing said inner member to said outer member comprises a depressible button in a side of said inner member, said button being sized and shaped to protrude through one of a plurality of holes in a corresponding side of said outer member, thereby securing said inner and outer members in place relative to one another, whereby said position of said inner member relative to said outer member may be varied by depressing said button and sliding said inner member within said outer member until said button protrudes through another one of said holes.

11. A lightweight tool extending apparatus as recited in claim 8 wherein said means for generating a focused light beam above said upper end of said inner member comprises a generally tube-shaped flashlight mounted to said inner member in generally parallel relation thereto.

12. A lightweight tool extending apparatus as recited in claim 8 further comprising an adapter for interconnecting said lower end of said outer member with said drive ratchets of varying sizes, said adapter having a first end with a certain outside diameter structured for removable interconnection with said lower end of said outer member and an opposite second open end with a certain inside diameter structured for interconnection with said drive ratchet.

13. A lightweight tool extending apparatus as recited in claim 8 further including a generally tube-like handle structured for removable insertion through a pair of opposing holes in said lower end of said outer member, said handle being structured to facilitate gripping and manipulating of said apparatus.

14. A lightweight tool extending apparatus comprising:

an outer tube-like member having a lower end structured for interconnection with a drive ratchet and an opposite open upper end;

an inner tube-like member structured for insertion into said upper end of said outer member in sliding relation thereto, said inner member having an upper portion with an upper end structured for interconnection with a drive head and a lower portion;

a universal joint structured to rotate and pivot about its longitudinal axis so that said upper portion may be translated relative to said lower portion and said outer member;

means for removably securing said inner member within said outer member so that the position of said inner member relative to said outer member may be varied between a first extended position, wherein said inner member is substantially removed from said outer member, to a second retracted position, wherein said inner member is substantially within said outer member; and a generally tube-shaped flashlight mounted to said inner member in generally parallel relation thereto, said flashlight being structured and disposed to generate a focused light beam above said upper end of said inner member.

15. A lightweight tool extending apparatus as recited in claim 14 wherein said means for removably securing said inner member within said outer member comprises a depressible button in a side of said inner member, said button being sized and shaped to protrude through one of a plurality of holes in a corresponding side of said outer member, thereby securing said inner and outer members in place relative to one another, whereby said position of said inner member relative to said outer member may be varied by depressing said button and sliding said inner member within said outer member until said button protrudes through another one of said holes.

16. A lightweight tool extending apparatus as recited in claim 14 further comprising an adapter for interconnecting said lower end of said outer member with said drive ratchets of varying sizes, said adapter having a first end with a certain outside diameter structured for removable interconnection with said lower end of said outer member and an opposite second open end with a certain inside diameter structured for interconnection with said drive ratchet.

17. A lightweight tool extending apparatus as recited in claim 14 further including a generally tube-like handle structured for removable insertion through a pair of opposing holes in said lower end of said outer member, said handle being structured to facilitate gripping and manipulating of said apparatus.

* * * * *